United States Patent [19]

Noorily

[11] 3,973,293

[45] Aug. 10, 1976

[54] BUNDLING STRAP

[75] Inventor: Peter Noorily, Holliswood, N.Y.

[73] Assignee: Thomas & Betts Corporation, Elizabeth, N.J.

[22] Filed: Feb. 2, 1976

[21] Appl. No.: 654,564

[52] U.S. Cl. ..... 24/16 PB

[51] Int. Cl.[2] ..... B65D 63/00

[58] Field of Search ..... 24/16 PB, 16 R, 17 R, 24/17 A, 17 B, 17 AP, 19, 73 SA, 20 TT, 25, 73 PB, 73 PF; 248/74 R, 74 B, 74 PB

[56] References Cited

UNITED STATES PATENTS

| | | | |
|---|---|---|---|
| 3,887,965 | 6/1975 | Schuplin | 24/16 PB |
| 3,909,884 | 10/1975 | Weckesser | 24/73 SA |
| 3,924,299 | 12/1975 | McCormick | 24/16 PB |

*Primary Examiner*—G. V. Larkin

*Attorney, Agent, or Firm*—David Teschner; Jesse Woldman

[57] ABSTRACT

The enlarged head portion of a preferably unitary molded bundling strap comprises, in one embodiment, a pair of independently supported, spaced, parallel barb means depending within an obliquely oriented opening extending through the head portion, the barb means being oriented in such manner as to be subjected to a non-deflecting force directed essentially along the longitudinal axis of the respective barb means upon coacting locking engagement with the selectively inclined mating surfaces of a plurality of transverse teeth located along one surface of a flat, flexible strap-like member extending from the head portion.

8 Claims, 8 Drawing Figures

BUNDLING STRAP

BACKGROUND OF THE INVENTION

1. Field of the Invention

The invention is directed to the field of tie means for disposition about one or more articles.

2. Description of the Prior Art

Bundling straps and the like for bundling together articles such as wire harnesses and the like are well known in the art and generally comprise an elongated plastic element of suitable flexibility having, at one end, an apertured head portion containing a locking barb or tongue for engagement with the body portion of the device as the body portion is drawn through the aperture in the head portion to form a loop about one or more articles to be enclosed therewithin. Prior art devices employing multiple barb arrangements are exemplified in U.S. Pat. No. 3,717,906 issued to Wells on Feb. 27, 1973, and in U.S. Pat. No. 3,739,429 issued to Kohke on June 19, 1973 and assigned to the assignee of the instant invention, the former patent disclosing a device in which a pair of barbs depending obliquely from opposing sidewalls of the apertured interior of the head portion of the tie are arranged to interlock with respective teeth located on opposing surfaces of the body portion of the tie. Otherwise, locking takes place in the conventional manner, i.e., by offset engagement between the barbs and the teeth wherein the barbs are subjected to a rotating torque tending to drive the free end of the barb deeper into the body portion of the strap upon attempted disengagement. The latter patent to Kohke also shows a pair of obliquely oriented barbs located in the apertured head portion of the device. However, the multiple barb arrangement shown in the Kohke patent is employed merely to provide a separate barb for each of a plurality of body portions extending from the head portion. Both types of devices, however, operate in essentially the same manner in that the barbs are pivotingly coupled within the head portion and are designed to pivot slightly about one end, wherein the force applied thereto upon attempted withdrawal of the strap body from the head portion is directed along an axis offset from the longitudinal axis of the barb, resulting in a bending moment tending to collapse or deform the barb, thus seriously limiting the usefulness and reliability of the tie where positive locking action is necessary or desirable.

SUMMARY OF THE INVENTION

The present invention overcomes the limitations and difficulties noted above with respect to prior art devices by providing, in a bundling strap, a unique barb arrangement and head portion construction which is designed to avoid collapse or deformation of the barbs resulting in a locking arrangement which is more positive and reliable than such prior art devices. Extending through the head portion of the bundling strap is a strap receiving opening oriented at an oblique angle to the preferably parallel front and rear surfaces of the head portion. Barb means, shown in one embodiment as two independently supported, parallel locking tongues depend from an inner wall of the head portion into the strap receiving opening, each barb having a selectively formed free end, the free ends being laterally and longitudinally displaced from one another along an axis joining such free ends and oriented substantially parallel to the longitudinal axis of the head portion opening.

The elongate member forming the body portion of the instant device is of generally flat, strap-like configuration and is provided with a plurality of transverse teeth extending along one surface thereof intermediate the head portion and the distal end of the elongate member. Each tooth is provided with a leading surface and a trailing surface, the trailing surface being planarly inclined to an axis perpendicular to the longitudinal axis of the elongate member so as to lockingly engage the adjacent end surface of a respective barb means. The barb means are axially oriented in such manner within the interior of the head portion as to be subjected to a predominantly longitudinal directed force applied by the trailing surface of an engaging tooth upon the attempted withdrawal of the elongate member from the head portion after engagement. The barb means are thus advantageously put in substantially pure compression in resisting the movement of the elongate member in the direction of withdrawal, with substantially no bending moments being created to collapse or otherwise deform the barb means. The device may be conveniently and inexpensively molded as a one piece element with the barb means formed integrally with the head portion to avoid costly and laborious assembly operations. The unique locking arrangement further permits the construction of relatively small bundling straps with increased holding capacity. The location and orientation of the barb means and the cooperative relationship established between the barb means and the engaged teeth within the interior of the head portion also provide a substantially tamper proof arrangement often lacking in many prior art devices. It is therefore an object of this invention to provide an improved bundling strap.

It is another object of this invention to provide a bundling strap having an improved locking arrangement.

It is a further object of this invention to provide an improved bundling strap constructed so as to avoid the collapse or deformation of a locking barb disposed within the head portion of the strap.

It is yet another object of this invention to maximize the locking engagement obtainable in a bundling strap employing interlocking barbs and teeth.

It is still another object of this invention to provide an improved bundling strap in which the locking barb is subjected to a substantially pure compressive force upon the attempted withdrawal of the body portion from the head portion of the strap.

It is still a further object of this invention to minimize, in a bundling strap having interlocking barbs and teeth, the offset forces tending to collapse or deform the locking barbs upon the attempted withdrawal of the body portion from the head portion of the strap.

Other objects and features will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings

Similar elements are given similar reference characters in each of the respective drawings.

DESCRIPTION OF THE PREFERRED EMBODIMENTS

Figure 1:
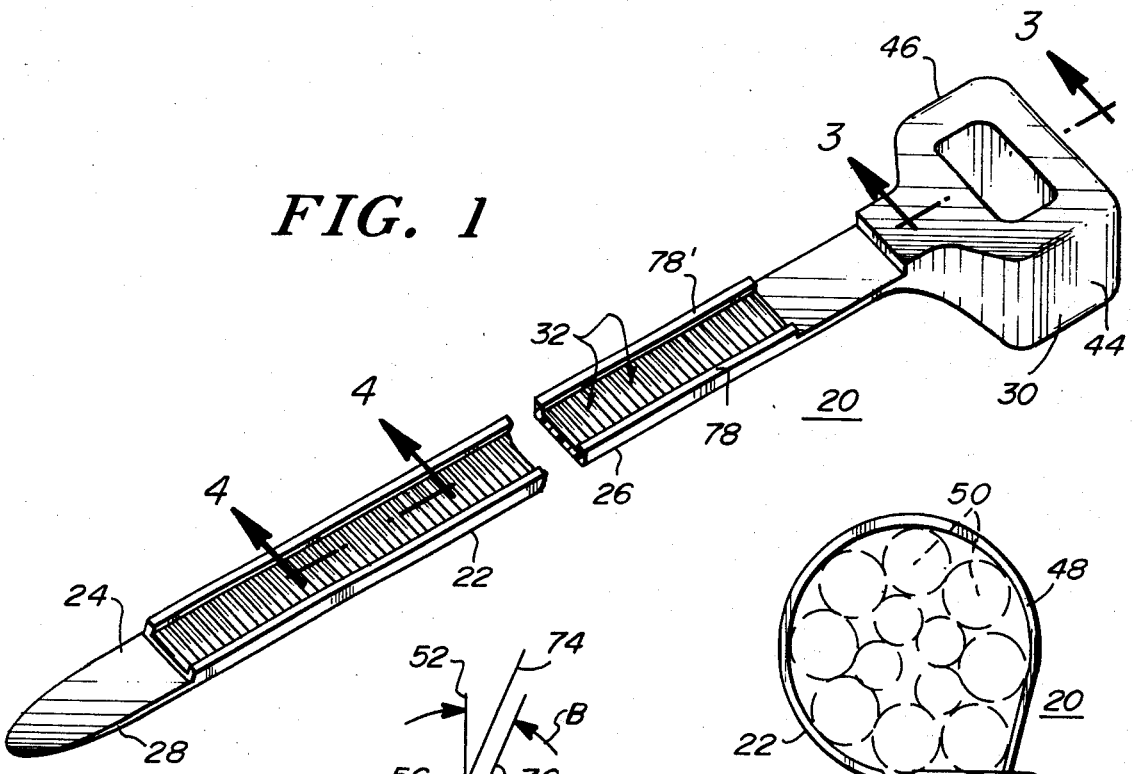
FIG. 1 is a perspective view, partly cut away and partly in section, of a bundling strap constructed in accordance with the concepts of the invention.

Referring now to FIGS. 1 through 7, there is shown a bundling strap 20 (FIG. 1) constructed in accordance with the concepts of the invention. The strap 20, which may be conveniently and inexpensively molded as a single piece item, comprises an elongate member 22 having an upper surface 24, a lower surface 26, a tail portion 28 at one end of the member 22, and an enlarged head portion 30 at the other end of the member 22. Extending along the length of the upper surface 24 of the member 22 are a series of transverse teeth 32 each defined by a leading surface 34 (FIG. 4) and a trailing surface 36, the trailing surface 36 being selectively inclined at an oblique angle A of between about ten and thirty degrees to an axis 38 disposed perpendicular to the longitudinal axis of the elongate member 22.

Figure 2:
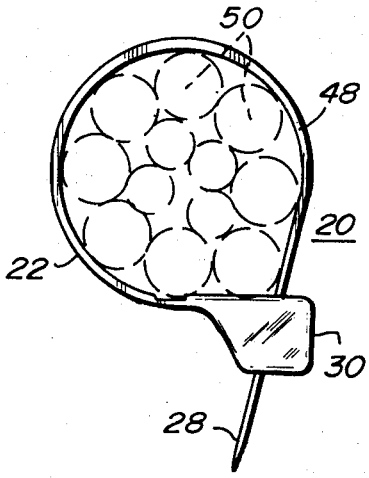
FIG. 2 is a side elevational view showing the device of FIG. 1 in an engaged condition.
Figure 3:
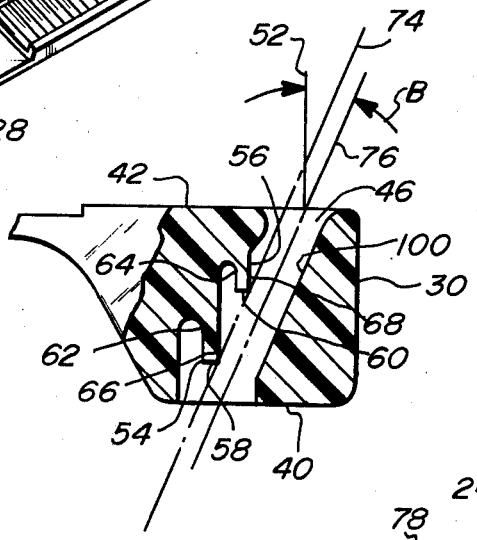
FIG. 3 is an enlarged fragmentary side elevational view, partly cut away and partly in section, taken along the line 3—3 of FIG. 1.
Figure 4:
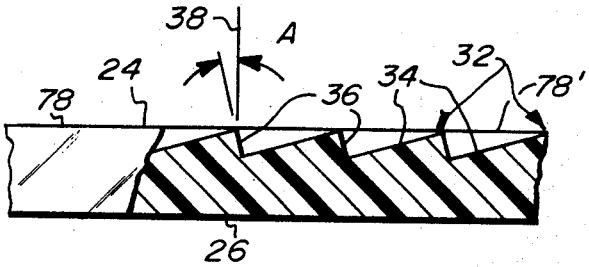
FIG. 4 is an enlarged fragmentary side elevational view, partly cut away and partly in section, taken along the line 4—4 of FIG. 1.
Figure 5:
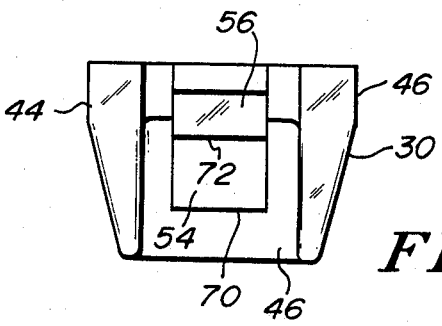
FIG. 5 is an enlarged fragmentary front elevational view partly in section, of the head portion of the device of FIG. 1.
Figure 7:
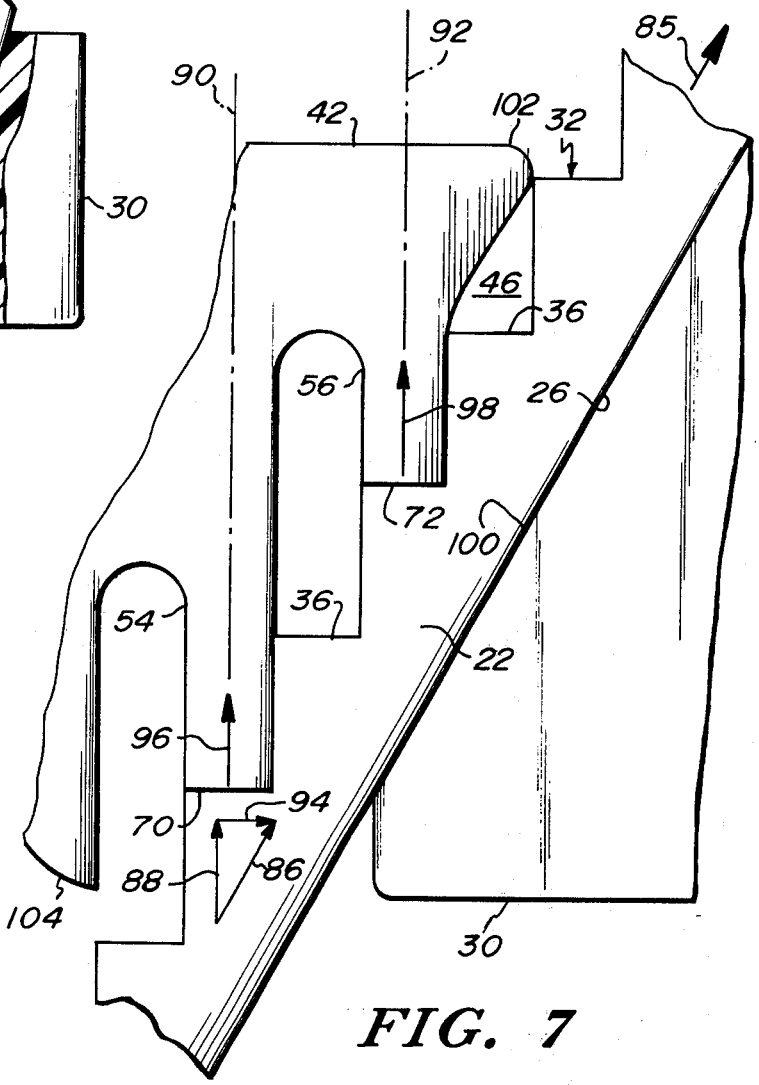
FIG. 7 is an enlarged diagrammatic view, showing the force vectors associated with the device of FIG. 1.
Figure 8:
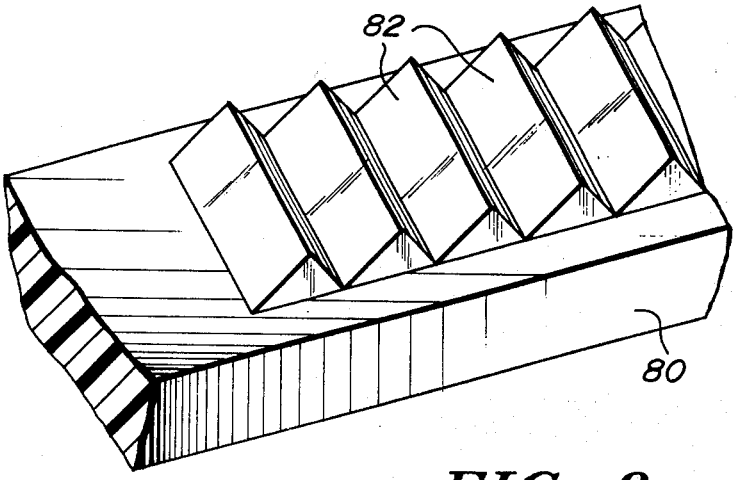
FIG. 8 is an enlarged fragmentary perspective view, partly in section, showing a further embodiment of the body portion of a bundling strap constructed in accordance with the concepts of the invention.

Referring now specifically to FIG. 3, the head portion 30 comprises a front surface 40 and a rear surface 42 parallel to one another and defining the height of the head portion 30, and side surfaces 44 and 46 (FIG. 1) defining its width. Extending between the front and rear surfaces 40 and 42, respectively is an opening 46 for receiving the member 22 therethrough to provide a looped configuration 48 (FIG. 2) about one or more articles indicated by the dotted outlines 50. The opening 46 extends through the head portion 30 at an oblique angle B to an axis 52 disposed generally perpendicular to the planes of the front and rear surfaces 40 and 42, respectively, of the head portion 30. Extending within the opening 46 are a first and second barb means 54 and 56, respectively, each being generally elongate and having a first end 58, 60, respectively, a second end 62, 64, respectively, and a body portion 66, 68, respectively, intermediate the respective first and second ends thereof. Each of the first and second barb means 54, 56, respectively, is longitudinally oriented substantially parallel to the axis 52 (FIG. 3) and terminates in a relatively flat tooth engaging surface 70, 72, respectively (FIG. 7), planarly oriented substantially normal to the longitudinal axis of the associated barb means and, consequently, generally parallel to the front and rear surfaces 40 and 42, respectively, of the head portion 30. Although only two such barb means 54 and 56 are shown and described, it will be readily apparent to those skilled in the art that additional barb means (not shown) may be added in similar manner within the head portion 30 without departing from the spirit of the invention and within the concepts herein disclosed. As further shown in FIG. 3, the first ends 58 and 60, respectively, of the first and second barb means 54 and 56, are longitudinally displaced from one another in stepped fashion, the first ends 58 and 60 of the barb means 54 and 56, respectively, lying along an axis 74 substantially parallel to an axis 76 extending longitudinally through the opening 46. The angle B defining the slope or inclination of the opening 46 in the head portion 30 is designed to be substantially equal to the angle A defining the slope or inclination of the trailing surfaces 36 of the teeth 32, and may similarly have a value of between about ten and thirty degrees. Accordingly, the trailing surfaces 36 of the teeth 32 will lie along respective axes parallel to the tooth engaging surface 70 and 72 of the respective barb means 54 and 56 upon interengagement of the teeth 32 and the barb means 54 and 56, as best seen in FIG. 7. As further illustrated in FIGS. 1 and 4, the teeth 32 are flanked by rib portions 78, 78′ extending along the length of the member 22 at approximately the same height as the teeth 32, and may be advantageously employed to provide additional strength to the member 22 and to protect the side surfaces of the teeth 32. The rib portions 78, and 78′ may, however, be eliminated to provide an elongate member 80 such as illustrated in FIG. 8, having totally exposed teeth 82, where necessary or desirable. Although the teeth 82 are showing as having a length somewhat less than the full width of the member 80, the teeth 82 may be lengthened so as to occupy substantially the entire width of the member 80.

Figure 6:
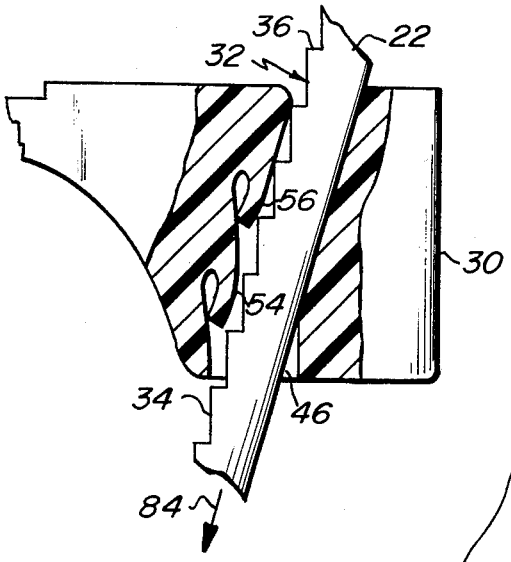
FIG. 6 is an enlarged fragmentary side elevational view, partly cut away and partly in section, showing the engagement between the body portion and the head portion of the device of FIG. 1.

Referring now specifically to FIG. 6, the member 22 is shown as being inserted into the opening 46 in a direction indicated by the arrow 84 to enclose one or more articles within a loop 48 in the manner illustrated, for example, in FIG. 2. As the teeth 32 of the member 22 traverse the barb means 54 and 56 during insertion, the barb means 54 and 56 are deflected away from the member 22 in response to the force exerted thereon by the leading surfaces 34 of the teeth 32. The member 22 may thus be inserted into the opening 46 to any desired position in accordance with the size of loop or the tightness desired about the articles 50.

Referring specifically to FIG. 7, two of the trailing surfaces 36 of the member 22 are shown abutting the respective tooth engaging surfaces 70 and 72 as the member 22 is subjected to a force in the direction of the arrow 85. A vector diagram showing the components of the force applied to the member 22 is shown at 86 wherein the primary force vector 85 is shown as comprising a first force component 88 substantially normal to the barb means tooth engaging surfaces 70 and 72 and coincident with the longitudinal axes 90 and 92 of the respective barb means 54 and 56, and a second force component 94 substantially parallel to the barb means tooth engaging surfaces 70 and 72. The direction of the first force component 88 in relation to the longitudinal axes of the barb means 54 and 56 is shown by the respective arrows 96 and 98 illustrated as in direct coincidence with the respective longitudinal axes 90 and 92. The relatively small force component 94, being substantially parallel to the tooth engaging surfaces 70 and 72 of the respective barb means 54 and 56 is thereby directed along a slipping plane and exerts essentially no offset force on the barb means 54 and 56. The barb means 54 and 56 are thus beam loaded in substantially pure compression thus providing maximum resistance to disengagement between the teeth 32 and the barb means 54 and 56 in the direction of pull out indicated by the arrow 85. As further illustrated in FIG. 7, the lower surface 26 of the elongate member 22 is supported by an adjacent surface 100 defining one wall of the opening 46 in the head portion 30, in the engaged position, to prevent any transverse shift of the member 22 away from the barb means 54 and 56 which may result from the application of the force component 94 to the member 22. As further shown in FIG. 7, access to the barb means 54 and 56 in the opening 46 is substantially totally obstructed by the presence of the member 22 therein, the head portion 30 further including a protuberance 102 at one end of the opening 46 adjacent the rear surface 42 of the head portion 30, and an extending portion 104 at the other end of the opening 46 adjacent the front surface 40 of the head portion 30. Accordingly, the locked assembly is effectively protected from tampering or the like. This feature may be found extremely useful where it is necessary or desirable to prevent unauthorized removal of the articles 50 from within the loop 48 without visible destruction or deformation of the head portion 30. The close proximity of the protuberance 102 to the teeth 32 also serves to maintain the portion of the elongate member 22 disposed within the opening 46 in a substantially linear configuration when the member 22 is looped about articles in the manner shown in FIG. 2, thus further preventing loss of contact between the trailing surfaces 36 of the member 22 and the associated tooth engaging surfaces 70 and 72 of the respective barb means 54 and 56.

The embodiments of the invention in which an exclusive property or privilege is claimed are defined as follows:

1. A tie means comprising: a generally flat flexible elongate member having an upper surface and a lower surface; a plurality of transverse teeth extending along said upper surface of said elongate member, each of said teeth having a leading surface and a trailing surface, said leading and said trailing surfaces of a respective tooth communicating with one another along a line, said trailing surface lying in a plane selectively oriented at an oblique angle to the longitudinal axis of said elongate member; an enlarged head portion at one end of said elongate member, said head portion having a front surface and a rear surface, said head portion front and rear surfaces being arranged in substantially parallel planar disposition, said head portion having an opening extending therethrough between said front and said rear surfaces, said opening being selectively axially oriented at an oblique angle to an axis perpendicular to the planes of said front and said rear surfaces for receiving said elongate member therethrough; at least two discrete, individually supported, elongate barb means depending from said head portion and extending substantially parallel with one another within said head portion opening, said barb means each having a first end, a second end, and a body portion therebetween, said barb means each extending along its respective longitudinal axis in a direction perpendicular to the planes of said front and said rear head portion surfaces, said first end of said barb means terminating in a tooth engaging surface selectively configured to interlock with a respective one of said elongate member teeth trailing surfaces upon the attempted withdrawal of said elongate member from within said head portion opening.

2. A tie means as defined in claim 1 wherein each of said barb means tooth engaging surfaces comprises a generally flat planar area oriented substantially perpendicular to the longitudinal axis of said barb means.

3. A tie means as defined in claim 1 wherein said barb means first ends are offset from one another along an axis substantially parallel to the longitudinal axis of said head portion opening.

4. A tie means as defined in claim 1 wherein said head portion opening is axially oriented at a first angle of between ten degrees and thirty degrees to an axis perpendicular to the planes of said front and said rear head portion surfaces, and wherein said trailing surfaces of said elongate member teeth each lie in a plane inclined at a second angle of between ten degrees and thirty degrees to an axis perpendicular to the longitudinal axis of said elongate member, said first angle and said second angle being substantially equal to one another.

5. A tie means as defined in claim 1 wherein said barb means are formed integral with said head portion.

6. A tie means as defined in claim 1 wherein each of said barb means tooth engaging surfaces comprises a generally flat planar area oriented substantially perpendicular to the longitudinal axis of said barb means, and wherein each of said trailing surfaces of said elongate member teeth is substantially flat for intimate contact with a respective flat planar area of said barb means tooth engaging surface.

7. A tie means as defined in claim 1 wherein said barb means first ends are offset from one another a distance substantially equal to the distance between at least two of said elongate member teeth.

8. A tie means as defined in claim 7 whrein said barb means first ends are offset from one another along an axis substantially parallel to the longitudinal axis of said head portion opening.

* * * * *